US005411559A

United States Patent [19]

Malfer

[11] Patent Number: 5,411,559

[45] Date of Patent: May 2, 1995

[54] SUCCINIMIDES

[75] Inventor: Dennis J. Malfer, Crestwood, Mo.

[73] Assignee: Ethyl Corporation, Richmond, Va.

[21] Appl. No.: 697,931

[22] Filed: May 3, 1991

Related U.S. Application Data

[62] Division of Ser. No. 480,905, Feb. 16, 1990, Pat. No. 5,312,555.

[51] Int. Cl.[6] ..... C10L 1/22

[52] U.S. Cl. ..... 44/347; 44/331

[58] Field of Search ..... 44/331, 347; 252/51.5 A; 548/546, 547

[56] References Cited

U.S. PATENT DOCUMENTS

| | | | |
|---|---|---|---|
| 3,018,291 | 1/1962 | Anderson et al. | 252/51.5 A |
| 3,024,237 | 3/1962 | Drummond et al. | 252/51.5 A |
| 3,185,704 | 5/1965 | Kahn et al. | 260/326.3 |
| 3,216,936 | 11/1965 | Le Suer | 252/32.7 |
| 3,219,666 | 11/1965 | Norman et al. | 252/51.5 R |
| 3,272,746 | 9/1966 | Le Suer et al. | 252/51.5 A |
| 3,639,242 | 2/1972 | Le Suer | 252/56 R |
| 3,708,522 | 1/1973 | Le Suer | 260/485 G |
| 4,199,462 | 4/1980 | Soula et al. | 252/51.5 A |
| 4,203,855 | 5/1980 | Steckel | 252/42.7 |
| 4,234,435 | 11/1980 | Meinhardt et al. | 252/51.5 |
| 4,645,515 | 2/1987 | Wallenberg | 44/63 |
| 4,647,390 | 3/1987 | Buckley et al. | 252/51.5 A |
| 4,652,273 | 3/1987 | Maldonado et al. | 44/63 |
| 4,676,917 | 6/1987 | Sung et al. | 252/51.5 A |
| 4,749,500 | 6/1988 | Forsberg et al. | 252/49.3 |
| 4,780,111 | 10/1988 | Dorer et al. | 44/71 |
| 4,798,612 | 1/1989 | Plavac et al. | 44/63 |

FOREIGN PATENT DOCUMENTS

| | | |
|---|---|---|
| 1162436 | 8/1969 | United Kingdom . |
| 8702663 | 5/1987 | WIPO . |

*Primary Examiner*—Margaret Medley

*Attorney, Agent, or Firm*—Dennis H. Rainear; William H. Thrower

[57] ABSTRACT

A product formed by reacting at least one acyclic hydrocarbyl substituted succinic acylating agent such as polyisobutenyl succinic anhydride with at least one N-(alkoxyalkyl)alkanediamine such as N-(isodecyloxypropyl)-1,3-diaminopropane is effective as a detergent-dispersant for liquid fuels and oleaginous liquids.

3 Claims, No Drawings

SUCCINIMIDES

This application is a division of application Ser. No. 07/480,905, filed Feb. 16, 1990, now U.S. Pat. No. 5,312,555.

TECHNICAL FIELD

This invention relates to detergents for use in fuels, lubricants, and functional fluids. More particularly it relates to novel ashless dispersant-detergents capable of reducing and/or preventing the deposit of solid materials in internal combustion engines and on mechanical surfaces such as gears, vehicular transmission parts, and the like.

BACKGROUND

The prior art discloses many ashless dispersants useful as additives in fuels and lubricant compositions. A large number of such ashless dispersants are derivatives of high molecular weight carboxylic acid acylating agents. Typically, the acylating agents are prepared by reacting an olefin (e.g., a polyalkene such as polybutene) or a derivative thereof, containing for example at least 30 to 50 aliphatic carbon atoms, with an unsaturated carboxylic acid or derivative thereof such as acrylic acid, methacrylic acid, maleic acid, fumaric acid and maleic anhydride. Dispersants are prepared from the high molecular weight carboxylic acid acylating agents by reaction with, for example, amines characterized by the presence within their structure of at least one N—H group, alcohols, reactive metal or reactive metal compounds, and combinations of the above. U.S. Pat. No. 4,234,435 summarizes some of the prior art relative to the preparation of such carboxylic acid derivatives.

It also has been suggested that the carboxylic acid derivative compositions such as those described above can be post-treated with various reagents to modify and improve the properties of the compositions. Acylated nitrogen compositions prepared by reacting the acylating reagents described above with an amine can be post-treated, for example, by contacting the acylated nitrogen compositions thus formed with one or more post-treated reagents selected from the group consisting of boron oxide, boron oxide hydrate, boron halides, boron acids, esters of boron acids, carbon disulfide, sulfur, sulfur chlorides, alkenyl cyanides, carboxylic acid acylating agents, aldehydes, ketones, phosphoric acid, epoxides, etc. Lists of the prior art relating to post-treatment of carboxylic ester and amine dispersants with reagents such as those described above are contained in a variety of patents such as U.S. Pat. No. 4,203,855 (Col. 19, lines 16–34) and U.S. Pat No. 4,234,435 (Col. 42, lines 33–46).

U.S. Pat. No. 3,216,936 describes lubricant additives which are compositions derived from the acylating of alkylene polyamines. More specifically, the compositions are obtained by reaction of an alkylene amine with an acidic mixture consisting of a hydrocarbon-substituted succinic acid having at least about 50 aliphatic carbon atoms in the hydrocarbon group and an aliphatic monocarboxylic acid, and thereafter removing the water formed by the reaction. The ratio of equivalents of said succinic acid to the mono-carboxylic acid in the acidic mixture is from about 1:0.1 to about 1:1. The aliphatic mono-carboxylic acids contemplated for use include saturated and unsaturated acids such as acetic acid, dodecanoic acid, oleic acid, naphthenic acid, formic acid, etc. Acids having 12 or more aliphatic carbon atoms, particularly stearic acid and oleic acid, are especially useful. The products described in the '936 patent also are useful in oil-fuel mixtures for two-cycle internal combustion engines.

British Pat. No. 1,162,436 describes ashless dispersants useful in lubricating compositions and fuels. The compositions are prepared by reacting certain specified alkenyl substituted succinimides or succinic amides with a hydrocarbon-substituted succinic acid or anhydride. The arithmetic mean of the chain lengths of the two hydrocarbon substituents is greater than 50 carbon atoms. Formamides of monoalkenyl succinimides are described in U.S. Pat. No. 3,185,704. The formamides are reported to be useful as additives in lubricating oils and fuels.

U.S. Pat. Nos. 3,639,242 and 3,708,522 describe compositions prepared by post-treating mono- and polycarboxylic acid esters with mono- or polycarboxylic acid acylating agents. The compositions thus obtained are reported to be useful as dispersants in lubricants and fuels.

U.S. Pat No. 4,780,111 describes fuel compositions containing a hydrocarbon-soluble dispersant prepared generally by the post-treatment of a nitrogen-containing composition with mono- and polycarboxylic acids which may be aliphatic or aromatic carboxylic acids, preferably the latter. The nitrogen-containing compositions which are post-treated in accordance with U.S. Pat. No. 4,780,111 are obtained by reacting an acylating agent with alkylene polyamines or alkanol amines. The patent reports that when such fuel compositions are utilized in internal combustion engines, and in particular, fuel-injected internal combustion engines, the amount of solid deposits of the various parts of the internal combustion engines are reduced.

PCT International Publication No. WO 87/02663 published May 7, 1987 describes succinimide derivatives of various structures including those of the formula

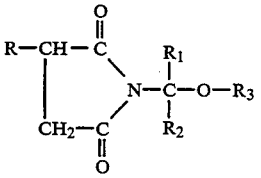

where R is a hydrocarbon group containing from about 8 to about 35 carbon atoms, $R_1$ and $R_2$ are each independently hydrogen or an alkyl group containing up to 8 carbon atoms, and $R_3$ is a hydrocarbon group containing up to about 28 carbon atoms. These compounds, which are reported to reduce the amount of fuel consumed during the operation of internal combustion engines, are made by reacting a succinimide of the formula

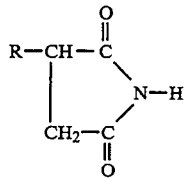

with an aldehyde or ketone ($R_1COR_2$) and an alcohol ($R_3$—OH).

The Invention

In accordance with one of its embodiments this invention provides a product formed by reacting at least one acyclic hydrocarbyl substituted succinic acylating agent with at least one N-(alkoxyalkyl)alkanediamine. Such products are effective detergent-dispersants for use in a variety of liquid fuels and oleaginous products.

The preferred products formed in this reaction are predominantly succinimides which may be represented by the general formula

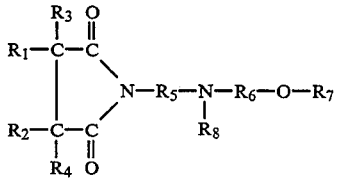

wherein $R_1$ is an acyclic hydrocarbyl group, preferably an alkyl or alkenyl group containing an average of at least 10 carbon atoms, preferably at least 16 carbon atoms (e.g., 16 to 1000 carbon atoms), and more preferably is an alkyl or alkenyl group derived from a polyolefin having a number average molecular weight as determined by gel permeation chromatography in the range of about 150 to about 10,000), and preferably in the range of 150 to 5000; each of $R_2$, $R_3$, and $R_4$ is, independently, an alkyl or alkenyl group containing up to about 6 carbon atoms or a hydrogen atom; each of $R_5$ and $R_6$ is, independently, a divalent acyclic hydrocarbylgroup containing up to about 10 carbon atoms (preferably an alkylene group containing 2 to 4, and most preferably 3, carbon atoms); $R_7$ is an alkyl group containing up to about 50 carbon atoms (preferably 8 to 24 carbon atoms); and $R_8$ is a hydrogen atom or an alkyl group containing up to about 6 carbon atoms (and most preferably is a hydrogen atom). In preferred compounds of this type, at least two of $R_2$, $R_3$, and $R_4$ are hydrogen atoms.

In other embodiments of this invention, there are provided fuel compositions, lubricant compositions, and functional fluid compositions containing minor but effective amounts of the detergent-dispersants of this invention.

When selecting compounds of this invention for particular uses there are a few generalizations that may prove helpful. However in using these generalizations it should be kept in mind that they are not hard-and-fast rules, as many extraneous factors such as specific type and composition of the medium being employed and the specific configuration of the additive being employed can change things from case to case. Nevertheless, the compounds of this invention wherein the total number of carbon atoms in $R_1$ and $R_7$ is relatively low, for example, about 40 or less are effective as detergent additives for gasoline-type fuels, and middle distillate fuels such as jet fuels, diesel fuels, and home heating oils. In this capacity, the compounds control or reduce deposit formation in injectors, ports, and on other related surfaces. When the total number of carbon atoms in $R_1$ and $R_7$ is increased to above about 40, for example in the range of 60 to 120, the compounds of this invention are not only effective as detergents but, additionally, can exhibit considerable effectiveness as additives for controlling or reducing intake valve deposits in spark-ignition and in compression-ignition engines. Compounds of this invention in which the total number of carbon atoms in $R_1$ and $R_7$ is in the range of 50 to 800 or more are useful as dispersants in lubricating oils and in functional fluids. The very high molecular weight compounds may also exhibit viscosity index improving properties in the oils.

In accordance with still another preferred embodiment, the detergent-dispersant is predominantly a hydrocarbon-soluble substituted succinimide represented by the general formula

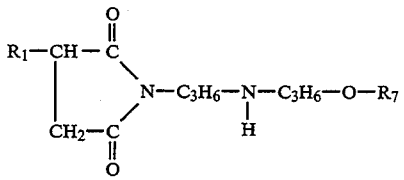

wherein $R_1$ is a substantially straight chain alkyl or alkenyl group averaging at least 12 carbon atoms (preferably an average in the range of 16 to 50 carbon atoms) and $R_7$ is an alkyl group containing up to about 50 carbon atoms (more preferably 8 to 24 carbon atoms and most preferably 10 to 18 carbon atoms).

In yet another preferred embodiment the detergent-dispersant of this invention is predominantly a substituted succinimide represented by the general formula

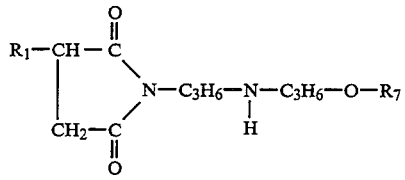

wherein $R_1$ is an alkyl or alkenyl group bifurcated on its beta carbon atom into two branches, one of which contains at least 4 carbon atoms and the other of which contains at least 6 carbon atoms, said group containing an average of at least 12 carbon atoms (preferably an average in the range of 16 to 50 carbon atoms) and $R_7$ is an alkyl group containing up to about 50 carbon atoms (more preferably 8 to 24 carbon atoms and most preferably 10 to 18 carbon atoms).

A still further preferred embodiment of this invention provides detergent-dispersants represented by the general formula

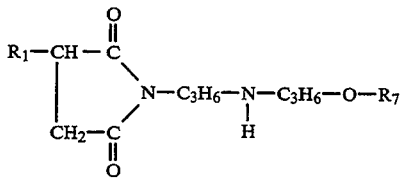

wherein $R_1$ is an alkyl or alkenyl group derived from a polyolefin, most preferably polyisobutene, having a number average molecular weight in the range of 250 to 5000, more preferably in the range of 400 to 4000 and most preferably in the range of 550 to 2500, and $R_7$ is an alkyl group containing up to about 50 carbon atoms (more preferably 8 to 24 carbon atoms and most preferably 10 to 18 carbon atoms).

Additive concentrates containing the detergent-dispersants of this invention consititute still further preferred embodiments of this invention.

These and other embodiments, features and advantages of this invention will become still further apparent from the ensuing description and appended claims.

Succinic Acylating Agents

As noted above, the detergent-dispersants of this invention are made from one or more aliphatic succinic acid acylating agents. As is well known, in reaction with co-reactive amines, such acylating agents may be used in the free acid form, in the form of a derivative thereof such as the anhydride, ester or acyl halide, or as a combination of any two or more of the foregoing.

One type of preferred acylating agent is an alkyl and/or alkenyl succinic anhydride or an alkyl or alkenyl succinic acid in which, in any case, the alkyl or alkenyl group is derived from a polyolefin having a number average molecular weight of about 150 to 10,000, more preferably in the range of about 150 to about 5,000 and most preferably in the range of about 250 to about 3000. As is well known, such acylating agents can be prepared by reacting maleic acid or maleic anhydride (or a congener thereof) with a polyolefin of appropriate number average molecular weight, with or without chlorine being utilized in the process. Polyolefins used in this process can vary substantially but preferably are derived from $\alpha$-olefins having up to about 8 carbon atoms in the molecule (or mixtures thereof). Examples of such polyolefins include polypropene, polybutene, polyisobutene, copolymers of propene and 1-butene, copolymers of 1-butene and isobutene, copolymers of propene and isobutene, and the like. Syntheses of this type are extensively reported in the literature. See for example the following U.S. Pat. Nos.:

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |
| 3,202,678 | 3,361,673 | 4,110,349 |
| 3,215,707 | 3,373,111 | 4,234,435 |
| 3,219,666 | 3,381,022 | |

Hydrogenation of the alkenyl succinic anhydrides or alkenyl succinic acids results in the formation of corresponding alkyl succinic anhydrides or alkyl succinic acids. The most preferred acylating agents of this type are the polyisobutenyl succinic acids and polyisobutenyl succinic anhydrides.

In lieu of maleic acid or maleic anhydride use may be made of related compounds in reaction with olefins or polyolefins to form the acylating agents. Such compounds include, for example, fumaric acid, itaconic acid, mesaconic acid, citraconic anhydride, malic acid, diethyl maleic anhydride, ethylmaleic anhydride, methylmaleic anhydride, and the corresponding acid halides and lower alkyl esters (i.e., alkyl groups having less than 7 carbon atoms).

Another type of preferred acylating agent is an alkyl and/or alkenyl succinic anhydride in which the alkyl or alkenyl group is substantially straight chain in configuration and contains at least 12 carbon atoms, and even more preferably an average of about 16 to about 50 carbon atoms. An especially preferred acylating agent of this type is octadecenylsuccinic acid or anhydride.

Still another preferred acylating agent is an alkyl- or alkenylsuccinic acid or anhydride in which the alkyl or alkenyl group is bifurcated on the beta-carbon atom and is composed of two substantially linear chains. Preferred alkyl groups of this type may be represented by the formula

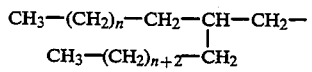

where n is an integer in the range of 2 to about 20. A preferred group of such bifurcated alkenyl groups may be represented by the formula

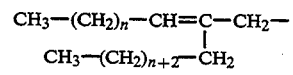

where n is an integer in the range of 2 to about 20. It will be understood and appreciated that the double bond in such alkenyl group may be isomerized to different positions from that depicted (which is the preferred position) by treating the alkenylsuccinic acid or anhydride with an isomerization catalyst such as silica gel, a trialkylborane, or the like. Such alkyl- and alkenyl-substituted succinic acids an anhydrides can be formed from dimerized 1-olefins such as by dimerizing 1-hexene, 1-heptene, 1-octene, 1-nonene, 1-decene, 1-undecene, 1-dodecene, 1-tetradecene, 4-methyl-1-pentene, 6-methyl-1-heptene, 5-ethyl-1-decene, or 3,5,5-trimethyl-1-undecene with an aluminum alkyl dimerization catalyst according to known procedures. See for example Ziegler et al, *Ann.* 629, 121–166 (1960) all disclosure of which is incorporated herein by reference. The resultant dimerized olefin (sometimes referred to as a Vinylidene olefin) is then used to alkylate maleic anhydride or an ester of maleic acid, etc., to form the alkenyl-substituted succinic acid compound by the "ene" reaction. See in this connection Hoffman, *Angew. Chem., Int. Ed.* (English), 8, 556–577 (1969); Snider, *J. Org. Chem.*, 39, 255 (1974); and Keung et al, *J. Chem. Educ.*, 49, 97–100 (1972), all disclosures of which are incorporated herein by reference. As is well known, the "ene" reaction may be facilitated by the use of a catalyst such as aluminum trichloride, alkyl aluminum sesquichloride or the like. To form the bifurcated alkyl substituent, the bifurcated alkenyl group of the resultant alkenyl-substituted succinic acid compound may be hydrogenated to saturate the double bond.

Similarly suitable alkyl- or alkenylsuccinic acids or anhydrides in which the alkyl or alkenyl group is bifurcated on the beta-carbon atom into two branches can be formed in analogous fashion using co-dimerized 1-olefin such as by co-dimerizing 1-butene and 1-octene, 1-hexene and 1-decene, 1-pentene and 1-dodecene, 4-methyl-1-pentene and 1-tetradecene, 1-octene and 1-decene, 1-nonene and 1-decene, 1-decene and 1-dodecene, 1-dodecene and 1-tetradecene, 2,7-dimethyl-1-octene and 1-decene, 2,7-dimethyl-1-octene and 1-dodecene, 1-tetradecene and 1-pentadecene, etc., using a co-dimerization catalyst such as an aluminum alkyl. Such co-dimerized olefins are then used in the "ene" reaction in the same manner as described above. Hydrogenation of the alkenyl succinic acid compound (anhydride, ester, etc.) yields the corresponding bifurcated alkyl succinic acid compound.

The acylating agent may contain polar substituents provided that the polar substituents are not present in proportions sufficiently large to alter significantly the hydrocarbon character of the acylating agent. Typical suitable polar substituents include halo, such as chloro and bromo, oxo, oxy, formyl, sulfenyl, sulfinyl, thio, nitro, etc. Such polar substituents, if present, preferably do not exceed 10% by weight of the total weight of the hydrocarbon portion of the acylating agent, exclusive of the carboxyl groups.

There are several processes for preparing the acylating agents. One such process involves the reaction of (1) maleic acid, or an acid derivative thereof, e.g., the acid halide, or anhydride with (2) an ethylenically unsaturated hydrocarbon containing at least about 10 aliphatic carbon atoms or a chlorinated hydrocarbon containing at least about 10 aliphatic carbon atoms at a temperature within the range of about 100°–300° C. The chlorinated hydrocarbon or ethylenically unsaturated hydrocarbon reactant can, of course, contain polar substituents, short chain (e.g., methyl, ethyl, etc.) pendant groups, and additional non-conjugated unsaturation.

When preparing the substituted succinic acid acylating agent according to one of these two processes, the maleic acid reactant usually corresponds to the formula $R'(—COOH)_n$, where $R_7$ is characterized by the presence of an ethylenically unsaturated carbon-to-carbon covalent bond and n is the integer 2. The acidic reactant can also be the corresponding carboxylic acid halide, anhydride, ester, or other equivalent acylating agent and mixtures of one or more of these. Ordinarily, the total number of carbon atoms in the maleic acid reactant will not exceed 10 and generally will not exceed 6. Exemplary acidic reactants are maleic acid, maleic anhydride, fumaric acid, methylmaleic acid, methylmaleic anhydride, ethylmaleic acid, ethylmaleic anhydride, propylmaleic anhydride, butylmaleic anhydride, chloromaleic acid, and the like. Due to considerations of economy and availability, the acid reactants usually employed are maleic acid and maleic anhydride.

The substantially saturated aliphatic hydrocarbon-substituted succinic acid and anhydrides are especially preferred as acylating agents used as starting materials in the present invention. The succinic acid acylating agents are readily prepared by reacting maleic anhydride with an olefin or a chlorinated hydrocarbon of suitable chain length such as a chlorinated polyolefin. The reaction involves merely heating the two reactants at a temperature of about 100°–300° C., preferably, 100°–200° C. The product from such a reaction is a substituted succinic anhydride where the substituent is derived from the olefin or chlorinated hydrocarbon as described in the above-cited patents. The product may be hydrogenated to remove all or a portion of any ethylenically unsaturated covalent linkages by standard hydrogenation procedure, if desired. The substituted succinic anhydrides may be hydrolyzed by treatment with water or steam to the corresponding acid and either the anhydride or the acid may be converted to the corresponding acid halide or ester by reacting with phosphorus halide, phenols, or alcohols.

The ethylenically unsaturated hydrocarbon reactant and the chlorinated hydrocarbon reactant used in the preparation of the acylating agents are principally olefins, olefin oligomers, substantially saturated petroleum fractions and substantially saturated olefin oligomers and the corresponding chlorinated products. They contain an average of at least 10 carbon atoms in the molecule. The oligomers and chlorinated oligomers derived from mono-olefins having from 2 to about 4 carbon atoms are preferred. The especially useful oligomers are the oligomers of such 1-monoolefins as ethylene, propene, 1-butene, and isobutene. Oligomers of medial olefins, i.e., olefins in which the olefinic linkage is not at the terminal position, likewise are useful. These are exemplified by 2-butene.

The low molecular weight interoligomers of 1-monoolefins such as illustrated above with each other and with other inter-oligomerizable olefinic substances are also useful sources of the ethylenically unsaturated reactant. Such interoligomers contain an average of at least 10 carbon atoms in the molecule, and include for example, those prepared by oligomerizing ethylene with propene, ethylene with isobutene, and ethylene with 1-butene, etc.

The chlorinated hydrocarbons and chlorinated ethylenically unsaturated hydrocarbons used in the preparation of the acylating agents also contain an average of at least 10 carbon atoms in the molecule. The preferred reactants are the above-described olefins and chlorinated olefins containing an average of at least 12 carbon atoms, preferably in the range of from about 16 to about 200 carbon atoms.

N-(Alkoxyalkyl)alkanediamines

The other reactant used in the formation of the detergent-dispersants of this invention is one or a mixture of N-(alkoxyalkyl)alkanediamines. Such compounds can be represented by the formula $$R_7—O—R_6—\underset{\underset{R_8}{|}}{N}—R_5—NH_2$$

wherein $R_5$, $R_6$, $R_7$, and $R_8$ are as defined above.

Examples of such N-(alkoxyalkyl)alkanediamines include

N-(octyloxyethyl)-1,2-diaminoethane,
N-(2-ethylhexyloxypropyl)-1,2-diaminoethane,
N-(decyloxypropyl)-N-methyl-1,3-diaminopropane,
N-(dodecyloxybutyl)-1,3-diaminobutane,
N-(tetradecyloxypropyl)-N-propyl-1,4-diaminobutane,
N-(octadecyloxyhexyl)-1,10-diaminodecane,
N-(eicosyloxypropyl)-N-allyl-1,4-diaminobutane,
N-(triacontyloxypropyl)-1,6-diaminohexane,
N-(tetracontyloxyethyl)-N-methyl-1,5-diaminopentane, N-(pentacontyloxybutyl)-1,5-diamino-3,3-dimethylpentane,
N-(isodecyloxypropyl)-1,3-diaminopropane,
N-(isotridecyloxypropyl)-1,3-diaminopropane,
N-(hexadecyloxypropyl)-N-ethyl-1,4-diaminobutane,
N-(butoxybutyl)-3-methyl-1,4-diaminobutane, and the like.

Reaction Parameters

The ratio of reactants utilized in the preparation of the compounds of this invention may be varied over a wide range. Generally, the reaction mixture will contain the reactants in approximately equimolar quantities, although either reactant may be present in excess. Thus the reactants will usually be employed in molar ratios falling in the range of about 2:1 to about 1:2 and most preferably in the vicinity of about 1:1.

The temperature of the reaction used to prepare the compounds of this invention is not critical, and generally, any temperature from room temperature up to the decomposition temperature of any of the reactants or the product can be utilized. Preferably, however, the temperature will be above about 50° C. and more generally from about 100° C. to about 250° C.

When preparing the dispersant-detergents of this invention, a mixture of one or more of the succinic acid-type acylating agents and one or more of the N-(alkoxyalkyl)alkanediamines is heated optionally in the presence of a normally liquid, substantially inert organic liquid solvent/diluent. Generally speaking, such solvent or diluent is employed when utilizing acylating agents in which the aliphatic substituent is of relatively low molecular weight, e.g., when it contains less than about 24 carbon atoms. On the other hand, with higher molecular weight aliphatic substituted acylating agents, e.g., those having a substituent derived from a polyolefin with a number average molecular weight of 700 or above, the reaction is often conducted in the absence of an ancillary diluent or solvent. In such case, a solvent or diluent will frequently be added to the reaction product after completion of the reaction in order to facilitate storage, handling and subsequent blending of the product with other materials. The reaction of the acylating agent with the N-(alkoxyalkyl)alkanediamine is accompanied by the formation of approximately one mole of water for each mole of acylating agent used. The removal of water formed may be effected by heating the product at a temperature above 100° C., preferably in the neighborhood of about 150° C. Removal of the water may be facilitated by blowing the reaction mixture with an inert gas such as nitrogen during heating. It may likewise be facilitated by the use of a solvent which forms an azeotrope with water. Such solvents are exemplified by benzene, toluene, xylene, naphtha, n-hexane, etc. The use of such solvents permits the removal of water at a lower temperature, e.g., 80° C.

The following Examples illustrate the preparation of the detergent-dispersants of this invention. Unless otherwise indicated in the following examples and elsewhere in the specification and claims, all parts and percentages are by weight.

EXAMPLE 1

To a reactor equipped with a stirrer, a Dean-Stark trap and a condenser are added 116.8 parts of mixed $C_{16}$ and $C_{18}$ alkenylsuccinic anhydrides and about 87 parts of xylene (mixed isomers). To this mixture are added 151.3 parts of N-(isodecyloxypropyl)-1,3-propanediamine and about 15 parts of xylene. The resultant mixture is heated to reflux with stirring until the water formed in the reaction has been collected in the Dean-Stark trap (ordinarily in about 3 hours). The reaction mixture is indicated by infra-red to contain succinimide. The product is then stripped to 80° C. at 50 mm Hg vacuum. The residue is about 250 parts of predominantly $C_{16}$and $C_{18}$ alkenylsuccinimides of N-(isodecyloxypropyl)-1,3-propanediamine. Such product may be represented by the formula

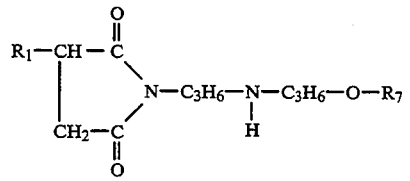

where $R_1$ is $C_{16}$ and $C_{18}$ alkenyl, and $R_7$ is isodecyl.

EXAMPLE 2

Using the procedure and apparatus as described in Example 1 above, 167 parts (0.15 mole) of polyisobutenylsuccinic anhydride (made from polyisobutene having a number average molecular weight of approximately 1136) is reacted with 46.0 parts (0.155 moles) of N-(isodecyloxypropyl)-1,3-diaminopropane in approximately 330 parts of o-xylene. After the stripping operation to 190° C. at 60 mm Hg, approximately 200 parts of product residue is recovered. This acylated product is predominantly a mixture of succinimides as depicted in Example 1 wherein $R_1$ is composed of polyisobutenyl groups with a number average molecular weight of about 1136.

EXAMPLE 3

To the reactor as described in Example 1 above are added 129.5 parts (0.114 mole) of polyisobutenylsuccinic anhydride (made from polyisobutene having a number average molecular weight of approximately 1136) and approximately 140 parts of xylene. After raising the temperature of this mixture to 50° C., 39.8 parts (0.114 mole) of N-(isotridecyloxypropyl)-1,3-diaminopropane is added. During the addition, the temperature of the reaction mixture rises to about 65° C. After evolution of water formed during reaction has ceased, the product is diluted with about 20 parts of xylene and distilled initially to 140° C. at 50 mm Hg and thereafter to 130° C. at 5 mm Hg. Approximately 160 parts of succinimide product is recovered. A sample of product made in this manner showed a total base number (TBN) of 41.5. Elemental analysis showed 81.4% C, 13.2% H, and 2.02% N, as compared to theoretical values of 81.2% C, 13.5% H, and 1.95% N. Thus the product of this reaction is composed predominantly of succinimide of the formula:

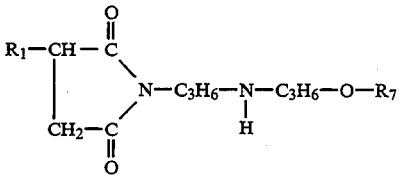

where $R_1$ is polyisobutenyl having a number average molecular weight of about 1136, and $R_7$ is isotridecyl.

EXAMPLE 4

To the reactor as described in Example 1 above are added 110 parts (0.074 mole) of polyisobutenylsuccinic anhydride (made from polyisobutene having a number average molecular weight of approximately 1493) and approximately 160 parts of xylene. Then 24 parts (0.078 mole) of N-(isodecyloxypropyl)-1,3-diaminopropane is added, followed by an additional 16 parts of xylene. During the reaction, an exotherm from about 48 to about 54° C. occurs. The mixture is refluxed until evolution of water ceases. The product is then stripped under water pump vacuum to about 130° C. The product is predominanly succinimide as depicted in Example 3 in which $R_1$ has a number average molecular weight of about 1493 and $R_7$ is isodecyl.

EXAMPLE 5

To a reactor equipped as in Example 1 above are charged 56 parts of branched $C_{16}$-alkenylsuccinic anhydride (in which the alkenyl group is formed from dimerized 1-octene) and 52 parts of xylene. Then 61 parts of N-(hexadecyloxyethyl)-1,4-diaminobutane and 52 parts of xylene are charged into the reactor, and the resultant mixture is heated with stirring to reflux while azeotropically removing the water formed during the reaction. After collecting the water evolved during the reaction, the product mixture is stripped to removed the xylene diluent. The residual acylated product is predominantly an alkenylsuccinimide of the formula

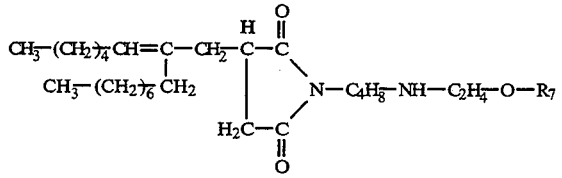

where $R_7$ is hexadecyl.

EXAMPLE 6

To a reactor equipped as in Example 1 above are charged 50 parts of branched $C_{20}$-alkenylsuccinic anhydride (in which the alkenyl group is formed from dimerized 1-decene) and 35 parts of xylene. Then 40 parts of N-(octyloxypentyl)-1,5-diaminopentane and 35 parts of xylene are charged into the reactor, and the resultant mixture is heated with stirring to reflux while azeotropically removing the water formed during the reaction. After collecting the water evolved during the reaction, the product mixture is stripped at reduced pressure to remove the xylene solvent. The residual acylated product is predominantly an alkenylsuccinimide of the formula

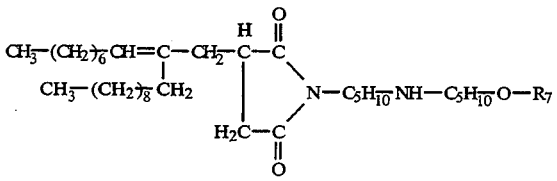

where $R_7$ is octyl.

EXAMPLE 7

Using the general procedure of Example 1 above, a mixture of $C_{16}$-, $C_{18}$-, $C_{20}$-, $C_{22}$-, $C_{24}$-, and $C_{26}$-alkenylsuccinic anhydrides with a number average molecular weight of 342 and N-(octadecyloxyethyl)-1,3-diaminopropane in equal molar quantities are reacted in refluxing xylene. The olefin mixture from which this alkenyl succinic anhydride reactant is made is composed, on a weight basis, of 0.8% $C_{16}H_{32}$, 8.2% $C_{18}H_{36}$, 42.2% $C_{20}H_{40}$, 33.3% $C_{22}H_{44}$, 14.7% $C_{24}H_{48}$ and 0.8% $C_{26}H_{52}$. After stripping the reaction mixture, a product composed predominantly of a mixture of $C_{16-26}$-alkenylsuccinimides of N-(octadecyloxyethyl)-1,3-diaminopropane is recovered. The alkenyl groups of this succinimide product are in proportions averaging in the range of from between about $C_{20}$ to about $C_{22}$.

EXAMPLE 8

Using the general procedure of Example 1 above, a mixture of $C_{22}$- and $C_{24}$-alkenylsuccinic anhydrides with a number average molecular weight of 440 and N-(pentadecyloxybutyl)-1,3-diaminopropane in equimolar quantities are reacted in refluxing xylene with removal of by-product water The product remaining after the stripping operation is predominantly an acylated compound of the formula

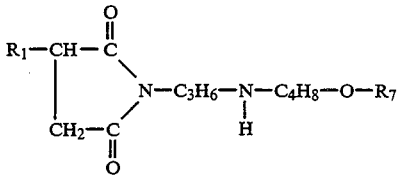

wherein $R_1$ is docosenyl ($C_{22}$) and tetracosenyl ($C_{24}$), and $R_7$ is pentadecyl.

EXAMPLE 9

50 Parts of polypropenylsuccinic anhydride (made from polypropene having a number average molecular weight of 500) is reacted with 32 parts of N-(hexadecyloxybutyl)-1,4-diaminobutane in refluxing zylene. The product remaining after stripping off the xylene solvent is predominantly polypropenylsuccinimide of N-(hexadecyloxybutyl)-1,4-diaminobutane.

EXAMPLE 10

Repetition of the procedure of Example 9 above using 50 parts of polyisobutenylsuccinic anhydride (made from polyisobutene having a number average molecular weight of 2400) and 5 parts of N-(2-ethylhexyloxypropyl)-1,3-diaminopropane yields polyisobutenylsuccinimide of N-(2-ethylhexyloxypropyl)-1,3-diaminopropane.

EXAMPLE 11

Hydrogenations at 60°-70° C. and about 30 psi hydrogen pressure using palladium on charcoal as catalyst are conducted on products made as in Examples 1-10 above yielding corresponding alkyl-substituted succinimide products.

EXAMPLE 12

By use of the general procedure set forth in Example 1, the following compounds are prepared from the alkenyl succinic anhydride in which the alkenyl group is a substantially straight chain alkenyl group of the appropriate specified chain length:

$C_{28}$ alkenylsuccinimide of N-(isodecyloxypropyl)-1,3-diaminopropane $C_{26}$ alkenylsuccinimide of N-(isodecyloxypropyl)-1,3-diaminopropane $C_{24}$ alkenylsuccinimide of N-(isodecyloxypropyl)-1,3-diaminopropane $C_{22}$ alkenylsuccinimide of N-(isodecyloxypropyl)-1,3-diaminopropane $C_{20}$ alkenylsuccinimide of N-(isodecyloxypropyl)-1,3-diaminopropane $C_{18}$ alkenylsuccinimide of N-(isodecyloxypropyl)-1,3-diaminopropane $C_{16}$ alkenylsuccinimide of N-(isodecyloxypropyl)-1,3-diaminopropane $C_{14}$ alkenylsuccinimide of N-(isodecyloxypropyl)-1,3-diaminopropane $C_{12}$ alkenylsuccinimide of N-(isodecyloxypropyl)-1,3-diaminopropane

EXAMPLE 13

By use of the general procedure set forth in Example 1, the following compounds are prepared from an alkyl-substituted succinic anhydride in which the alkyl group is a substantially straight chain alkyl group of the appropriate specified chain length:

$C_{28}$ alkylsuccinimide of N-(isotridecyloxypropyl)-1,3-diaminopropane $C_{26}$ alkylsuccinimide of N-(isotridecyloxypropyl)-1,3-diaminopropane $C_{24}$ alkylsuccinimide of N-(isotridecyloxypropyl)-1,3-diaminopropane $C_{22}$ alkylsuccinimide of N-(isotridecyloxypropyl)-1,3-diaminopropane $C_{20}$ alkylsuccinimide of N-(isotridecyloxypropyl)-1,3-diaminopropane $C_{18}$ alkylsuccinimide of N-(isotridecyloxypropyl)-1,3-diaminopropane $C_{16}$ alkylsuccinimide of N-(isotridecyloxypropyl)-1,3-diaminopropane $C_{14}$ alkylsuccinimide of N-(isotridecyloxypropyl)-1,3-diaminopropane $C_{12}$ alkylsuccinimide of N-(isotridecyloxypropyl)-1,3-diaminopropane

EXAMPLE 14

By use of the general procedure set forth in Example 3, the following compounds are prepared from an alkenyl succinic anhydride in which the alkenyl group contains the appropriate number of carbon atoms and is branched on its beta carbon atom into two branches, one of which contains two less carbon atoms than the other:

$C_{28}$ alkenylsuccinimide of N-(isodecyloxypropyl)-1,3-diaminopropane $C_{26}$ alkenylsuccinimide of N-(isodecyloxypropyl)-1,3-diaminopropane $C_{24}$ alkenylsuccinimide of N-(isodecyloxypropyl)-1,3-diaminopropane $C_{22}$ alkenylsuccinimide of N-(isodecyloxypropyl)-1,3-diaminopropane $C_{20}$ alkenylsuccinimide of N-(isodecyloxypropyl)-1,3-diaminopropane $C_{18}$ alkenylsuccinimide of N-(isodecyloxypropyl)-1,3-diaminopropane $C_{16}$ alkenylsuccinimide of N-(isodecyloxypropyl)-1,3-diaminopropane $C_{14}$ alkenylsuccinimide of N-(isodecyloxypropyl)-1,3-diaminopropane $C_{12}$ alkenylsuccinimide of N-(isodecyloxypropyl)-1,3-diaminopropane

EXAMPLE 15

By use of the general procedure set forth in Example 3, the following compounds are prepared from an alkyl-substituted succinic anhydride in which the alkyl group contains the appropriate number of carbon atoms and is branched on its beta carbon atom into two branches, one of which contains two less carbon atoms than the other:

$C_{28}$ alkylsuccinimide of N-(isotridecyloxypropyl)-1,3-diaminopropane $C_{26}$ alkylsuccinimide of N-(isotridecyloxypropyl)-1,3-diaminopropane $C_{24}$ alkylsuccinimide of N-(isotridecyloxypropyl)-1,3-diaminopropane $C_{22}$ alkylsuccinimide of N-(isotridecyloxypropyl)-1,3-diaminopropane $C_{20}$ alkylsuccinimide of N-(isotridecyloxypropyl)-1,3-diaminopropane $C_{18}$ alkylsuccinimide of N-(isotridecyloxypropyl)-1,3-diaminopropane $C_{16}$ alkylsuccinimide of N-(isotridecyloxypropyl)-1,3-diaminopropane $C_{14}$ alkylsuccinimide of N-(isotridecyloxypropyl)-1,3-diaminopropane $C_{12}$ alkylsuccinimide of N-(isotridecyloxypropyl)-1,3-diaminopropane The compounds of this invention are useful as detergent-dispersant additives for a variety of normally liquid hydrocarbon fuels and oleaginous liquids including lubricating oils, gear oils, hydraulic fluids, automatic transmission fluids, cutting oils, and the like. For use as dispersants in lubricating oils and functional fluids, it is desirable to employ compounds of this invention in which the alkyl or alkenyl substituent of the acylating agent contains at least 40 carbon atoms.

The compounds of this invention, particularly those in which the alkyl or alkenyl substituent of the acylating agent contains from 10 to about 80 carbon atoms, are useful as detergent-dispersant additives for distillate fuels, notably gasoline, diesel fuel, domestic and light industrial burner fuels, jet fuels, kerosene, gas turbine engine fuels, and the like. When employed in such fuels, the additives are effective in controlling or reducing the amount of undesirable deposits formed on various mechanical surfaces, such as injectors, intake valves, intake manifolds, intake ports, carburetor surfaces, and the like. Generally speaking, when it is desired to employ a compound of this invention for the purpose of reducing intake valve deposits, use should be made of a product in which the alkyl or alkenyl substituent of the acylating agent contains at least about 30 carbon atoms. Compounds of this invention wherein the alkyl or alkenyl substituent are of shorter chain length are generally more useful for control of deposits on or in other engine parts such as injectors, intake ports, and carburetors.

The gasoline and middle distillate fuels in which the additives of this invention are employed are not restricted to straight-run distillate fractions. The distillate fuel can be straight-run distillate fuel, catalytically or thermally cracked (including hydrocracked) distillate fuel, or a mixture of straight-run distillate fuel, naphthas and the like with cracked distillate stocks. The hydrocarbon fuels also can contain non-hydrocarbonaceous materials such as alcohols, ethers, organonitro compounds, etc. Such materials can be mixed with the hydrocarbon fuel in varying amounts of up to about 10–20% or more. For example, alcohols such as methanol, ethanol, propanol and butanol, and mixtures of such alcohols are included in commercial fuels in amounts of up to about 10%. Other examples of materials which can be mixed with the fuels include diethyl ether, methyl ethyl ether, methyl tertiary butyl ether, and nitromethane. Also included within the scope of the invention are liquid fuels derived from vegetable or mineral sources such as corn, alfalfa, shale and coal. Also, the base fuels used in the formation of the fuel compositions of the present invention can be treated in accordance with well-known commercial methods, such as acid or caustic treatment, hydrogenation, solvent refining, clay treatment, etc.

Gasolines are supplied in a number of different grades depending on the type of service for which they are intended. The gasolines utilized in the present invention include those designed as motor and aviation gasolines. Motor gasolines include those defined by ASTM specification D-430-73 and are comprised of a mixture of olefins, paraffins, isoparaffins, naphthenes and occasionally diolefins. Motor gasolines normally have a boiling range within the limits of about 70° F. to 450° F. while aviation gasolines have narrower boiling ranges, usually within the limits of about 100° F.–330° F.

Fuel compositions containing a minor, property improving amount of at least one hydrocarbon-soluble detergent-dispersant of the type described herein have the desirable ability of preventing or minimizing undesirable intake valve deposits. The compounds of this invention are also useful as detergent-dispersants for use in middle distillate (diesel) fuels to prevent or reduce deposits in fuel injectors, in fuel lines, and/or in related parts of the engine.

Yet another aspect of this invention is a method for reducing deposits, especially induction system or intake valve deposits, in an internal combustion engine, which method comprises: (i) blending with a major amount of a liquid hydrocarbon fuel a minor amount of a hydrocarbon-soluble detergent-dispersant of this invention sufficient to reduce the formation of engine deposits; and (ii) using the fuel composition in an internal combustion engine.

The effectiveness of the compounds of this invention in reducing carburetor deposits was demonstrated by a series of standard CRC carburetor tests. On completion of each such engine test the weight of deposits formed on the carburetor sleeve during the test was measured. Thus the lower the weight, the more effective was the fuel composition. The same base fuel was used in each series of tests, and the additives employed therein and results obtained are summarized in Tables I–III below. All additive concentrations are expressed therein as pounds per thousand barrels (ptb). For purposes of comparison, Table I also shows the results of a test in which the additive employed was the succinimide made from the same alkenyl succinic anhydride as in Example 1, but using N-(decyloxypropyl)amine as the amine reactant. This comparative product thus had the formula:

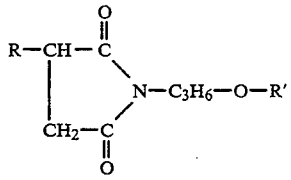

where R is $C_{16}$ and $C_{18}$ alkenyl, and R′ is decyl. Baseline runs were conducted before and after the runs on the fuels containing the additives and the values shown in the tables are the averages of such before and after runs.

TABLE I

| Additive | Additive Conc., ptb | Sleeve Wt., mq | % Reduction |
|---|---|---|---|
| None | — | 27.2 | — |
| Example 1 | 10 | 3.0 | 89.0 |
| Comparative | 10 | 23.0 | 15.4 |

TABLE II

| Additive | Additive Conc., ptb | Sleeve Wt., mq | % Reduction |
|---|---|---|---|
| None | — | 27.2 | — |
| Example 1 | 10 | 1.7 | 93.8 |

TABLE III

| Additive | Additive Conc., ptb | Sleeve Wt., mq | % Reduction |
|---|---|---|---|
| None | — | 23.9 | — |
| Example 1 | 5 | 14.2 | 40.6 |

Another series of standard engine tests demonstrated the effectiveness of the longer chain aliphatic substituted compounds of this invention in controlling or reducing intake valve deposits. Such tests were conducted in a single-cylinder 3 hp Briggs & Stratton engine connected to a dynamometer and operated at 3000 rpm for 150 hours with a 0.67 hp load. The engine lubricant was SAE 10W-40 oil, and oil level adjustments were made at 10 hour intervals. The weight of intake valve deposits was determined from the weight of the valve before and after the test.

In these tests the clear gasoline gave 200 to 220 mg of intake valve deposits. On the other hand, when the fuel contained 100 ptb and 75 ptb of a product made as in Example 2, intake valve deposits were completely eliminated. At 50 ptb, 54.4 mg of intake valve deposits formed. With 50 ptb of mineral oil carrier fluid, 50 ptb of this additive gave 14.3 mg of deposits. A commercial intake valve cleanliness additive, when used at a concentration of 100 ptb in the same fuel, gave 5.7 mg of intake valve deposits.

The amount of the detergent-dispersant of this invention included in the fuel compositions may vary over a wide range although it is preferred not to include unnecessarily large excesses of the detergent-dispersant. The amount included in the fuel should be an amount sufficient to improve the desired properties such as the prevention and/or reduction in the amount of deposits on the various parts of internal combustion engines such as in the carburetor and the fuel injector nozzles when the fuel is used to operate internal combustion engines. The fuel may contain from about 1 to about 10,000, and preferably from about 5 to about 5000 parts per million parts by weight of the fuel. The detergent-dispersants of this invention utilized in the fuel compositions are hydrocarbon-soluble in the sense that the detergent-dispersants are at least sufficiently soluble in the hydrocarbon fuel being employed to provide a solution containing the desired concentrations specified above.

The fuel compositions can be prepared by adding the detergent-dispersants of this invention to a liquid hydrocarbon fuel, or a concentrate of the detergent-dispersant in a substantially inert, normally liquid organic solvent-/diluent such as mineral oil, xylene, or a normally liquid fuel as described above can be prepared, and the concentrate added to the liquid hydrocarbon fuel. The concentrates generally contain about 5–95, usually 10–90% of the detergent-dispersant of the invention, and the concentrate can also contain any of the conventional additives for fuels such as those described below.

In addition to the detergent-dispersant of this invention, other conventional fuel additives can be employed in the fuel compositions and concentrates provided by the present invention. Thus, the fuels can contain anti-knock agents such as tetraalkyllead compounds, organomanganese additives such as methylcyclopentadienylmanganese tricarbonyl, lead scavengers such as haloalkanes (e.g., ethylene dichloride and ethylene dibromide), deposit preventors or modifiers such as trialkyl or triaryl phosphates, dyes, antioxidants such as 2,6-di-tert-butyl phenol, 2,6-di-tert-butyl-4-methyl phenol, rust-inhibitors, such as alkylated succinic acids and anhydrides, gum inhibitors, metal deactivators, demulsifiers, upper cylinder lubricants, anti-icing agents, etc. The middle distillate or diesel fuels may contain ignition accelerators such as alkyl nitrates, combustion improvers such as methylcyclopentadienylmanganese tricarbonyl, alcohols, corrosion inhibitors, antioxidants, stabilizers, particulate reducing additives, and the like.

When employed as additives in lubricating oils and functional fluids, the compounds of this invention may be utilized in conjunction with all known types of conventional lubricant or functional fluid additives with which they are compatible. Thus the lubricants and functional fluids of this invention can contain viscosity index improvers, extreme pressure additives, wear inhibitors, other detergents or dispersants, corrosion inhibitors, thermal stabilizers, antioxidants, sulfur-scavengers, and like materials in their conventional quantities.

The detergent-disperants utilized according to the invention can be incorporated in a wide variety of lubricants and functional fluids. They can be used in lubricating oil compositions, such as automotive crankcase lubricating oils, automatic transmission fluids, gear oils, etc. and in functional fluids such as hydraulic fluids, quenching oils, etc. in effective amounts to provide active ingredient concentrations in finished formulations generally within the range of 0.5 to 10 weight percent, for example, 1 to 9 weight percent, preferably 2 to 8 weight percent, of the total composition. Conventionally, the detergent-dispersants are admixed with the lubricating oils and oleaginous fluids as detergent-dispersant solution concentrates which usually contain up to about 50 weight percent of the active ingredient additive compound dissolved in mineral oil, preferably a mineral oil having an ASTM D-445 viscosity of 2 to 40, preferably 3 to 12 centistokes at 100° C. The base oils not only can be hydrocarbon oils of lubricating viscosity derived from petroleum but also can be natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of lubricating oils and synthetic oils in any proportion, etc. The detergent-dispersant may be conveniently dispersed as a concentrate of 10 to 80 weight percent of mineral oil, e.g., Solvent 100 Neutral oil, with or without other additives being present and such concentrates are a further embodiment of this invention.

Oleaginous compositions, especially crankcase lubricating oils, containing the detergent-dispersants of the present invention will also contain other well-known additives such as the zinc dialkyl ($C_3$–$C_8$) and/or diaryl ($C_6$–$C_{10}$) dithiophosphate wear inhibitors, generally present in amounts of about 0.5 to 5 weight percent. Useful detergents include the oil-soluble normal basic or overbased metal, e.g., calcium, magnesium, barium, etc., salts of petroleum naphthenic acids, petroleum sulfonic acids, alkyl benzene sulfonic acids, oil-soluble fatty acids, alkyl salicylic acids, sulfurized or unsulfurized alkyl phenates, and hydrolyzed or unhydrolyzed phosphosulfurized polyolefins. Gasoline engine crankcase lubricants typically contain, for example, from 0.5 to 5 weight percent of one or more detergent additives. Diesel engine crankcase oils may contain substantially higher levels of detergent additives. Preferred detergents are the calcium and magnesium normal or overbased phenates, sulfurized phenates or sulfonates.

Oxidation inhibitor include hindered phenols (e.g., 2,6-di-tert-butyl-para-cresol, 2,6-di-tert-butylphenol, 4,4'-methylenebis(2,6-di-tert-butylphenol), and mixed methylene bridged polyalkyl phenols, amines, sulfurized phenols and alkyl phenothiazines. Antioxidants are usually present in the lubricant in amounts of from 0.001 to 1 weight percent.

Pour point depressants which may be present in amounts of from 0.01 to 1 weight percent include wax alkylated aromatic hydrocarbons, olefin polymers and copolymers, and acrylate and methacrylate polymers and copolymers.

Viscosity index improvers, the concentrations of which may vary in the lubricants from 0.2 to 15 weight percent, (preferably from about 0.5 to about 5 weight percent) depending on the viscosity grade required, include hydrocarbon polymers grafted with, for example, nitrogen-containing monomers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethyiaminoalkyl methacrylate, post-grafted polymers of ethylene-propylene with an active monomer such as maleic anhydride which may be further reacted with an alcohol or an alkylene polyamine, styrene/-maleic anhydride polymers post-treated with alcohols and amines, etc.

Antiwear activity can be provided by about 0.01 to 2 weight percent in the oil of metal dihydrocarbyl dithiophosphates and the corresponding precursor esters, phosphosulfurized pinenes, sulfurized olefins and hydrocarbons, sulfurized fatty esters and alkyl polysulfides. Preferred are the zinc dihydrocarbyl dithiophosphates which are salts of dihydrocarbyl esters of dithiophosphoric acids.

Other additives include effective amounts of friction modifiers or fuel economy additives such as the alkyl phosphonates as disclosed in U.S. Pat. No. 4,356,097, aliphatic hydrocarbyl substituted succinimides as disclosed in EPO 0020037, dimer acid esters, as disclosed in U.S. Pat. No. 4,105,571, oleamide, etc., which are present in the oil in amounts of 0.1 to 5 weight percent. Glycerol oleates are another example of fuel economy additives and these are usually present in very small amounts, such as 0.05 to 0.2 weight percent based on the weight of the formulated oil.

In resume, this invention involves a substantial number of important embodiments involving the novel detergent-dispersants of this invention and their utilization. Among such embodiments are the following:

I. A product formed by reacting at least one acyclic hydrocarbyl substituted succinic acylating agent with at least one N-(alkoxyalkyl)alkanediamine.

II. A composition of I wherein the product is composed predominantly of succinimide represented by the following formula:

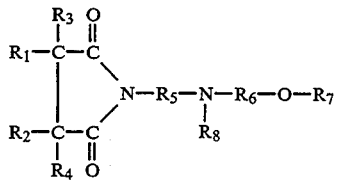

wherein $R_1$ is an acyclic hydrocarbyl group containing an average of 10 to 1000 carbon atoms; each of $R_2$, $R_3$, and $R_4$ is, independently, an alkyl or alkenyl group containing up to about 6 carbon atoms or a hydrogen atom; each of $R_5$ and $R_6$ is, independently, a divalent acyclic hydrocarbyl group containing up to about 10 carbon atoms; $R_7$ is an alkyl group containing up to about 50 carbon atoms; and $R_8$ is a hydrogen atom or an alkyl group containing up to about 6 carbon atoms.

III. A composition of II wherein $R_1$ is derived from a polyolefin having a number average molecular weight in the range of about 150 to about 5,000, at least two of $R_2$, $R_3$, and $R_4$ are hydrogen atoms, each of $R_5$ and $R_6$ is, independently, an alkylene group containing 2 to 4 carbon atoms, $R_7$ is an alkyl group containing 8 to 24 carbon atoms, and $R_8$ is a hydrogen atom.

IV. A composition of III wherein each of $R_5$ and $R_6$ is an alkylene group containing 3 carbon atoms.

V. A composition of I wherein the product is composed predominantly of succinimide represented by the following formula:

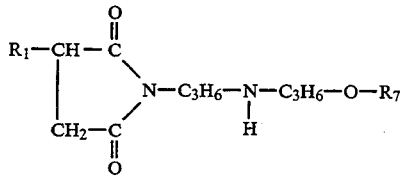

wherein $R_1$ is a substantially straight chain alkyl or alkenyl group having an average in the range of from 12 to 50 carbon atoms and $R_7$ is an alkyl group containing up to about 50 carbon atoms.

VI. A composition of V wherein $R_1$ has an average in the range of from 16 to 50 carbon atoms and $R_7$ contains an average of 8 to 24 carbon atoms.

VII. A composition of VI wherein $R_7$ contains an average of 10 to 18 carbon atoms.

VIII. A composition of I wherein the product is composed predominantly of succinimide represented by the following formula:

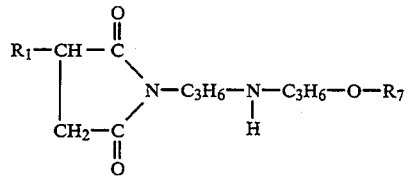

wherein $R_1$ is an alkyl or alkenyl group bifurcated on its beta carbon atom into two branches, one of which contains at least 4 carbon atoms and the other of which contains at least 6 carbon atoms, said group containing an average of in the range of 12 to 50 carbon atoms and $R_7$ is an alkyl group containing up to about 50 carbon atoms.

IX. A composition of VIII wherein $R_7$ contains an average of 8 to 24 carbon atoms.

X. A composition of IX wherein $R_7$ contains an average of 10 to 18 carbon atoms.

XI. A composition of I wherein the product is composed predominantly of succinimide represented by the following formula:

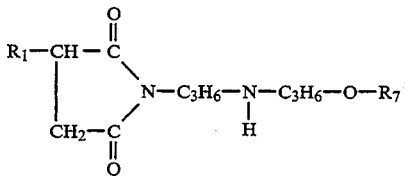

wherein $R_1$ is an alkyl or alkenyl group derived from a polyolefin, having a number average molecular weight in the range of 250 to 5000 and $R_7$ is an alkyl group containing up to about 50 carbon atoms.

XII. A composition of XI wherein $R_1$ is an alkenyl group derived from polyisobutene having a number average molecular weight in the range of 550 to 2500.

XIII. A composition of XII wherein $R_7$ contains an average of 8 to 24 carbon atoms.

XIV. A composition of XIII wherein $R_7$ contains an average of 10 to 18 carbon atoms.

XV. A liquid fuel for internal combustion engines, said fuel containing a minor effective amount of a product formed by reacting at least one acyclic hydrocarbyl substituted succinic acylating agent with at least one N-(alkoxyalkyl)alkanediamine.

XVI. A composition of XV wherein the product is composed predominantly of succinimide represented by the following formula:

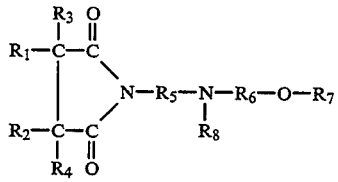

wherein $R_1$ is an acyclic hydrocarbyl group containing an average of 10 to 1000 carbon atoms; each of $R_2$, $R_3$, and $R_4$ is, independently, an alkyl or alkenyl group containing up to about 6 carbon atoms or a hydrogen atom; each of $R_5$ and $R_6$ is, independently, a divalent acyclic hydrocarbyl group containing up to about 10 carbon atoms; $R_7$ is an alkyl group containing up to about 50 carbon atoms; and $R_8$ is a hydrogen atom or an alkyl group containing up to about 6 carbon atoms.

XVII. A composition of XVI wherein $R_1$ is derived from a polyolefin having a number average molecular weight in the range of about 150 to about 5,000, at least two of $R_2$, $R_3$, and $R_4$ are hydrogen atoms, each of $R_5$ and $R_6$ is, independently, an alkylene group containing 2 to 4 carbon atoms, $R_7$ is an alkyl group containing 8 to 24 carbon atoms, and $R_8$ is a hydrogen atom.

XVIII. A composition of XVII wherein each of $R_5$ and $R_6$ is an alkylene group containing 3 carbon atoms.

XIX. A composition Of XV wherein the product is composed predominantly of succinimide represented by the following formula:

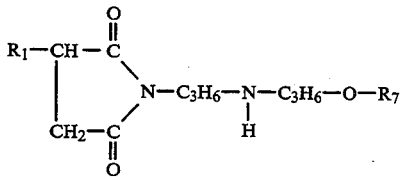

wherein $R_1$ is a substantially straight chain alkyl or alkenyl group having an average in the range of from 12 to 50 carbon atoms and $R_7$ is an alkyl group containing up to about 50 carbon atoms.

XX. A composition of XIX wherein $R_1$ has an average in the range of from 1 to 50 carbon atoms and $R_7$ contains an average of 8 to 24 carbon atoms.

XXI. A composition of XX wherein $R_7$ contains an average of 10 to 18 carbon atoms.

XXII. A composition of XV wherein the product is composed predominantly of succinimide represented by the following formula:

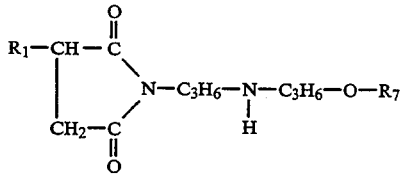

wherein $R_1$ is an alkyl or alkenyl group bifurcated on its beta carbon atom into two branches, one of which contains at least 4 carbon atoms and the other of which contains at least 6 carbon atoms, said group containing an average of in the range of 12 to 50 carbon atoms and $R_7$ is an alkyl group containing up to about 50 carbon atoms.

XXIII. A composition of XXII wherein $R_7$ contains an average of 8 to 24 carbon atoms.

XXIV. A composition of XXIII wherein $R_7$ contains an average of 10 to 18 carbon atoms.

XXV. A composition of XV wherein the product is composed predominantly of succinimide represented by the following formula:

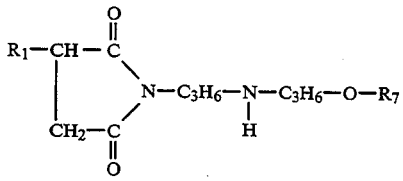

wherein $R_1$ is an alkyl or alkenyl group derived from a polyolefin, having a number average molecular weight in the range of 250 to 5000 and $R_7$ is an alkyl group containing up to about 50 carbon atoms.

XXVI. A composition of XXV wherein $R_1$ is an alkenyl group derived from polyisobutene having a number average molecular weight in the range of 550 to 2500.

XXVII. A composition of XXVI wherein $R_7$ contains an average of 8 to 24 carbon atoms.

XXVIII. A composition of XXVII wherein $R_7$ contains an average of 10 to 18 carbon atoms.

XXIX. A composition as claimed in claim XV wherein the liquid fuel is gasoline.

XXX. A composition as claimed in claim XV wherein the liquid fuel is diesel fuel.

XXXI. An oleaginous liquid containing a minor effective amount of a product formed by reacting at least one acyclic hydrocarbyl substituted succinic acylating agent with at least one N-(alkoxyalkyl)alkanediamine.

XXXII. A composition of XXXI wherein the product is composed predominantly of succinimide represented by the following formula:

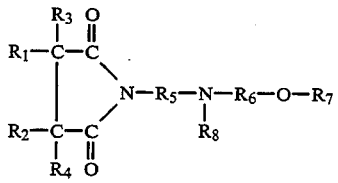

wherein $R_1$ is an acyclic hydrocarbyl group containing an average of 10 to 1000 carbon atoms; each of $R_2$, $R_3$, and $R_4$ is, independently, an alkyl or alkenyl group containing up to about 6 carbon atoms or a hydrogen atom; each of $R_5$ and $R_6$ is, independently, a divalent acyclic hydrocarbyl group containing up to about 10 carbon atoms; $R_7$ is an alkyl group containing up to about 50 carbon atoms; and $R_8$ is a hydrogen atom or an alkyl group containing up to about 6 carbon atoms.

XXXIII. A composition of XXXII wherein $R_1$ is derived from a polyolefin having a number average molecular weight in the range of about 150 to about 5,000, at least two of $R_2$, $R_3$, and $R_4$ are hydrogen atoms, each of $R_5$ and $R_6$ is, independently, an alkylene group containing 2 to 4 carbon atoms, $R_7$ is an alkyl group containing 8 to 24 carbon atoms, and $R_8$ is a hydrogen atom.

XXXIV. A composition of XXXIII wherein each of $R_5$ and $R_6$ is an alkylene group containing 3 carbon atoms.

XXXV. A composition of XXXI wherein the product is composed predominantly of succinimide represented by the following formula:

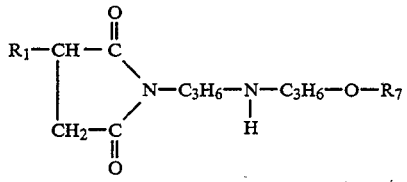

wherein $R_1$ is a substantially straight chain alkyl or alkenyl group having an average in the range of from 12 to 50 carbon atoms and $R_7$ is an alkyl group containing up to about 50 carbon atoms.

XXXVI. A composition of XXXV wherein $R_1$ has an average in the range of from 16 to 50 carbon atoms and $R_7$ contains an average of 8 to 24 carbon atoms.

XXXVII. A composition of XXXVI wherein $R_7$ contains an average of 10 to 18 carbon atoms.

XXXVIII. A composition of XXXI wherein the product is composed predominantly of succinimide represented by the following formula:

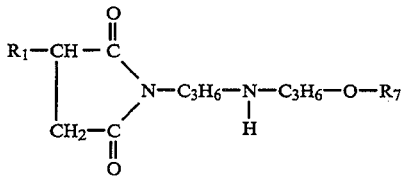

wherein $R_1$ is an alkyl or alkenyl group bifurcated on its beta carbon atom into two branches, one of which contains at least 4 carbon atoms and the other of which contains at least 6 carbon atoms, said group containing an average of in the range of 12 to 50 carbon atoms and $R_7$ is an alkyl group containing up to about 50 carbon atoms.

XXXIX. A composition of XXXVIII wherein $R_7$ contains an average of 8 to 24 carbon atoms.

XL. A composition of XXXIX wherein $R_7$ contains an average of 10 to 18 carbon atoms.

XLI. A composition of XXXI wherein the product is composed predominantly of succinimide represented by the following formula:

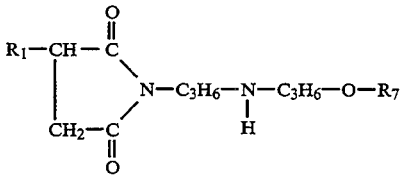

wherein $R_1$ is an alkyl or alkenyl group derived from a polyolefin, having a number average molecular weight in the range of 250 to 5000 and $R_7$ is an alkyl group containing up to about 50 carbon atoms.

XLII. A composition of XLI wherein $R_1$ is an alkenyl group derived from polyisobutene having a number average molecular weight in the range of 550 to 2500.

XLIII. A composition of XLII wherein $R_7$ contains an average of 8 to 24 carbon atoms.

XLIV. A composition of XLIII wherein $R_7$ contains an average of 10 to 18 carbon atoms.

XLV. A composition of XXXI wherein the oleaginous liquid is a lubricating oil.

XLVI. A composition of XXXI wherein the oleaginous liquid is a functional fluid.

XLVII. An additive concentrate which comprises a product formed by reacting at least one acyclic hydrocarbyl substituted succinic acylating agent with at least one N-(alkoxyalkyl)alkanediamine dissolved in a compatible solvent therefor.

XLVIII. A composition of XLVII wherein the product is composed predominantly of succinimide represented by the following formula:

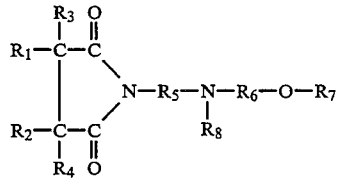

wherein $R_1$ is an acyclic hydrocarbyl group containing an average of 10 to 1000 carbon atoms; each of $R_2$, $R_3$, and $R_4$ is, independently, an alkyl or alkenyl group containing up to about 6 carbon atoms or a hydrogen atom; each of $R_5$ and $R_6$ is, independently, a divalent acyclic hydrocarbyl group containing up to about 10 carbon atoms; $R_7$ is an alkyl group containing up to about 50 carbon atoms; and $R_8$ is a hydrogen atom or an alkyl group containing up to about 6 carbon atoms.

XLIX. A composition of XLVIII wherein $R_1$ is derived from a polyolefin having a number average molecular weight in the range of about 150 to about 5,000, at least two of $R_2$, $R_3$, and $R_4$ are hydrogen atoms, each of $R_5$ and $R_6$ is, independently, an alkylene group containing 2 to 4 carbon atoms, $R_7$ is an alkyl group containing 8 to 24 carbon atoms, and $R_8$ is a hydrogen atom.

L. A composition of XLIX wherein each of $R_5$ and $R_6$ is an alkylene group containing 3 carbon atoms.

LI. A composition of XLVII wherein the product is composed predominantly of succinimide represented by the following formula:

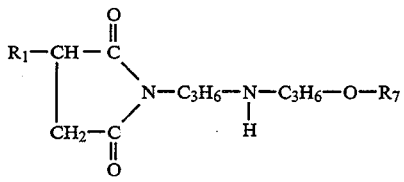

wherein $R_1$ is a substantially straight chain alkyl or alkenyl group having an average in the range of from 12 to 50 carbon atoms and $R_7$ is an alkyl group containing up to about 50 carbon atoms.

LII. A composition of LI wherein $R_1$ has an average in the range of from 16 to 50 carbon atoms and $R_7$ contains an average of 8 to 24 carbon atoms.

LIII. A composition of LII wherein $R_7$ contains an average of 10 to 18 carbon atoms.

LIV. A composition of XLVII wherein the product is composed predominantly of succinimide represented by the following formula:

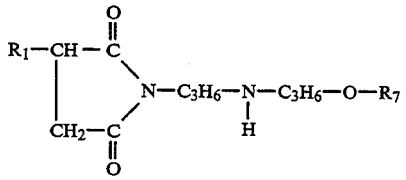

wherein $R_1$ is an alkyl or alkenyl group bifurcated on its beta carbon atom into two branches, one of which contains at least 4 carbon atoms and the other of which contains at least 6 carbon atoms, said group containing an average of in the range of 12 to 50 carbon atoms and $R_7$ is an alkyl group containing up to about 50 carbon atoms.

LV. A composition of LIV wherein $R_7$ contains an average of 8 to 24 carbon atoms.

LVI. A composition of LV wherein $R_7$ contains an average of 10 to 18 carbon atoms.

LVII. A composition of XLVII wherein the product is composed predominantly of succinimide represented by the following formula:

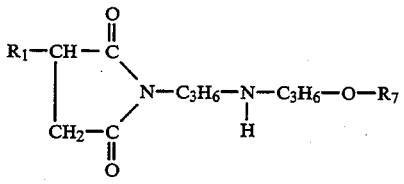

wherein $R_1$ is an alkyl or alkenyl group derived from a polyolefin, having a number average molecular weight in the range of 250 to 5000 and $R_7$ is an alkyl group containing up to about 50 carbon atoms.

LVIII. A composition of LVII wherein $R_1$ is an alkenyl group derived from polyisobutene having a number average molecular weight in the range of 550 to 2500.

LIX. A composition of LVIII wherein $R_7$ contains an average of 8 to 24 carbon atoms.

LX. A composition of LIX wherein $R_7$ contains an average of 10 to 18 carbon atoms.

This invention is susceptible to considerable variation in its practice within the spirit and scope of the ensuing claims, the embodiments described hereinbefore being illustrative, but not limitative, of its practice.

What is claimed is:

1. A liquid gasoline fuel for internal combustion engines, said fuel containing a minor effective amount of a product formed by reacting at least one acyclic hydrocarbyl substituted succinic acylating agent with at least one N-(alkoxyalkyl)alkanediamine wherein the product is composed predominantly of succinimide represented by the following formula:

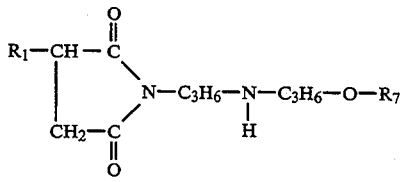

wherein $R_1$ is an alkyl or alkenyl group bifurcated on its beta carbon atom into two branches, one of which contains at least 4 carbon atoms and the other of which contains at least 6 carbon atoms, said group containing an average of in the range of 12 to 50 carbon atoms and $R_7$ is an alkyl group containing up to about 50 carbon atoms.

2. A composition as claimed in claim 1 wherein $R_7$ contains an average of 8 to 24 carbon atoms.

3. A composition as claimed in claim 2 wherein $R_7$ contains an average of 10 to 18 carbon atoms.

* * * * *